US007584773B2

(12) United States Patent
Van Bortel

(10) Patent No.: US 7,584,773 B2
(45) Date of Patent: Sep. 8, 2009

(54) WOOD-SPLITTING TOOL

(76) Inventor: Brett Van Bortel, 28W570 Lorraine Dr., Winfield, IL (US) 60190

( * ) Notice: Subject to any disclaimer, the term of this patent is extended or adjusted under 35 U.S.C. 154(b) by 195 days.

(21) Appl. No.: 11/688,944

(22) Filed: Mar. 21, 2007

(65) Prior Publication Data

US 2008/0230150 A1 Sep. 25, 2008

(51) Int. Cl.
*B27L 7/06* (2006.01)

(52) U.S. Cl. ..... 144/193.2; 144/195.7; 144/195.8

(58) Field of Classification Search ..... 144/193.2, 144/195.1, 195.7, 195.8, 195.5; 30/167, 30/168; 254/104
See application file for complete search history.

(56) References Cited

U.S. PATENT DOCUMENTS

| | | | | |
|---|---|---|---|---|
| 52,216 | A | 1/1866 | Silkman | |
| D44,646 | S | 9/1913 | Thomson | |
| D45,277 | S | 2/1914 | Vaughan | |
| 1,209,262 | A * | 12/1916 | Church | 254/104 |
| 1,321,143 | A | 11/1919 | Piehl | |
| 1,380,559 | A | 6/1921 | Jespersen | |
| 1,545,024 | A * | 7/1925 | Woodings et al. | 30/168 |
| 1,554,387 | A | 9/1925 | Thomson | |
| 2,910,771 | A * | 11/1959 | Farmer | 30/168 |
| 4,175,601 | A | 11/1979 | Meyer, III | |
| 4,194,544 | A | 3/1980 | Scott et al. | |
| D269,494 | S | 6/1983 | Tremaglio et al. | |
| D271,559 | S | 11/1983 | Reimann et al. | |
| 4,445,555 | A | 5/1984 | Klempirik | |
| D297,500 | S | 9/1988 | Kaplan | |
| 5,188,159 | A | 2/1993 | Lush | |
| 6,390,162 | B1 | 5/2002 | Sahlem | |
| 2007/0062046 | A1 * | 3/2007 | Hsu | 30/167 |

* cited by examiner

*Primary Examiner*—Shelley Self
(74) *Attorney, Agent, or Firm*—Neal Gerber & Eisenberg LLP

(57) ABSTRACT

A wood-splitting tool includes a penetration portion having a penetrating end and a wedge portion having an impact end. The penetration portion is configured for penetration into a piece of wood. The penetration portion includes two penetration surfaces diverging generally from each other at an inclusive angle generally from the penetrating end. The wedge portion includes two wedge surfaces generally contiguous with the diverging penetration surfaces and diverging from each other at an inclusive angle, which is greater than the inclusive angle of the diverging penetration surfaces. The wedge portion is primarily configured to impart a wedge force to the wood. The penetration portion has a length that is greater than half the length of the tool, which allows the tool to penetrate the piece of wood without significantly imparting a wedge force until the tool penetrates deep enough to allow the wedge portion to engage the wood.

21 Claims, 2 Drawing Sheets

WOOD-SPLITTING TOOL

TECHNICAL FIELD

The present invention relates to the field of wood-splitting tools, and, more particularly, a wood-splitting tool incorporating features improving penetration, engagement/traction, splitting, and efficiency properties of the tool.

BACKGROUND

Many tools have been developed over the years to enable the splitting of wood, such as logs or timber, with the aid of an impact tool, such as a mallet or hammer. Although some of these tools have provided adequate results, many of these tools suffer from several chronic problems or drawbacks. For instance, many of these tools are difficult to drive into a piece of wood and have mediocre penetration properties. Additionally, many tools disengage the wood piece too easily and accidentally "pop out" of the wood piece when the tool is impacted with a hammer or mallet, thereby creating a potential safety hazard. Many of these tools are designed with a primary emphasis on splitting the wood piece with a wedge action, with minimal cutting or penetrating action, which contributes to this disengagement problem.

The present invention addresses these and other concerns, and generally provides an improved wood-splitting tool, as will become apparent from the following written description, drawings, and claims.

SUMMARY OF THE INVENTION

The present invention is a wood-splitting tool that provides, among other things, increased pre-splitting penetration into a piece of wood, improved traction in the piece of wood after initial penetration, improved engagement with the piece of wood, and overall increased wood-splitting efficiency.

In accordance with the principles of the present invention, the wood-splitting tool includes a penetration portion having a penetrating end and a wedge portion having an impact end. The penetration portion is configured for penetration into a piece of wood. The penetration portion includes two penetration surfaces diverging from each other at an inclusive angle. The wedge portion includes two wedge surfaces generally contiguous with the diverging penetration surfaces and diverging from each other at an inclusive angle, which is greater than the inclusive angle of the diverging penetration surfaces. The wedge portion is primarily configured to impart a wedge force to the wood. The penetration portion has a length that is greater than half the length of the tool, which allows the tool to penetrate the piece of wood without significantly imparting a wedge force until the tool penetrates deep enough to allow the wedge portion to engage the wood.

DETAILED DESCRIPTION OF PREFERRED EMBODIMENTS

Figure 1:
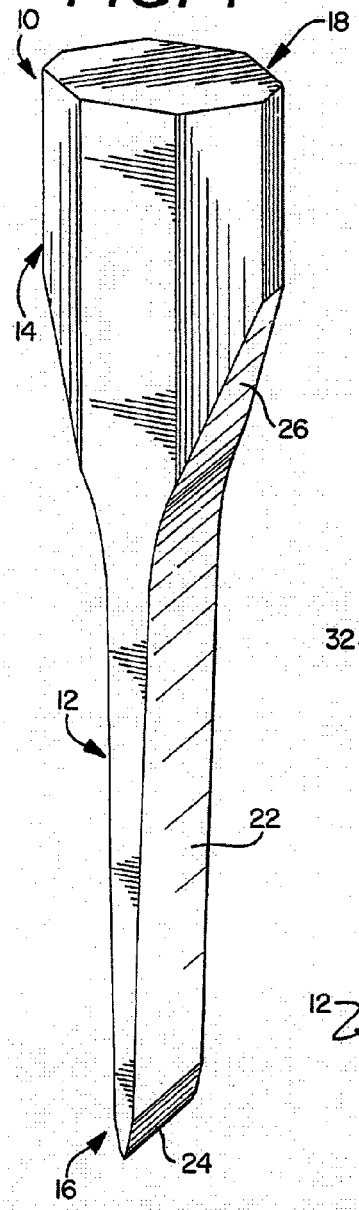
FIG. 1 is a perspective view of a particular embodiment of a wood-splitting tool in accordance with the principles of the present invention.

The description that follows describes, illustrates and exemplifies one or more particular embodiments of the present invention in accordance with its principles. This description is not provided to limit the invention to the embodiments described herein, but rather to explain and teach the principles of the invention in such a way to enable one of ordinary skill in the art to understand these principles and, with that understanding, be able to apply them to practice not only the embodiments described herein, but other embodiments that may come to mind in accordance with these principles. The scope of the present invention is intended to cover all such embodiments that may fall within the scope of the appended claims, either literally or under the doctrine of equivalents.

It is noted that in the description and drawings, like or substantially similar elements may be labeled with the same reference numerals. However, sometimes these elements may, but not always, be labeled with differing numbers in cases where such labeling may facilitate a more clear description. Additionally, the drawings set forth herein are not necessarily drawn to scale, and in some instances proportions may have been exaggerated to more clearly depict certain features.

Figure 2:
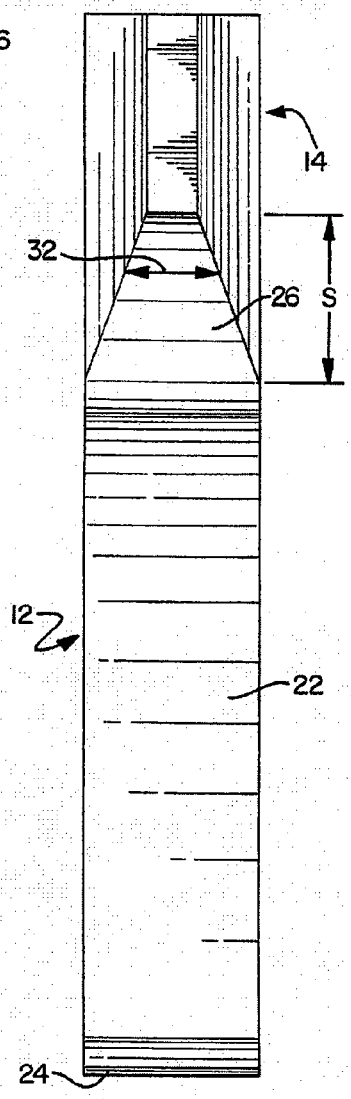
FIG. 2 is a front elevational view of the wood-splitting tool of FIG. 1.
Figure 3:
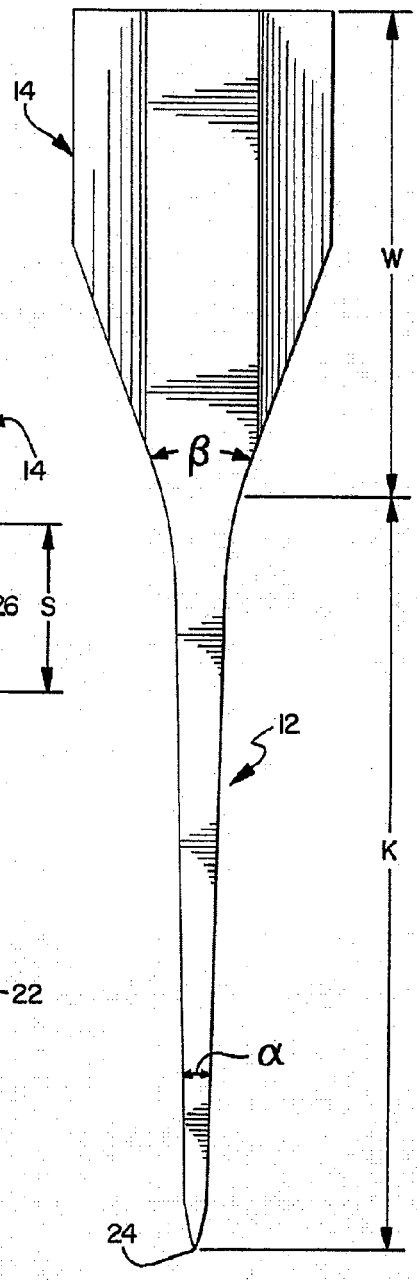
FIG. 3 is a side elevational view of the wood-splitting tool of FIG. 1, illustrating a comparison of length dimensions of the penetration portion and the wedge portion of the wood-splitting tool of FIG. 1.

In accordance with the principles of the present invention, FIGS. 1-3 show a wood-splitting tool 10. The tool 10 is generally elongated and defines an overall length, a penetration portion 12 and a wedge portion 14. The tool 10 includes a penetration end 16 adjacent the penetration portion 12 and an impact end 18 adjacent the wedge portion 14. The impact end 18 is generally configured to accept an impact force from an impact tool, such as a hammer, mallet, or other tool known in the art to impart an impact force. The penetration portion 12 is generally configured to primarily penetrate into a piece of wood. The wedge portion 14 is generally configured to primarily impart a wedge force to the wood, i.e., a force having a direction that is generally transverse to the length of the tool 10 to facilitate splitting of the wood.

Figure 4:
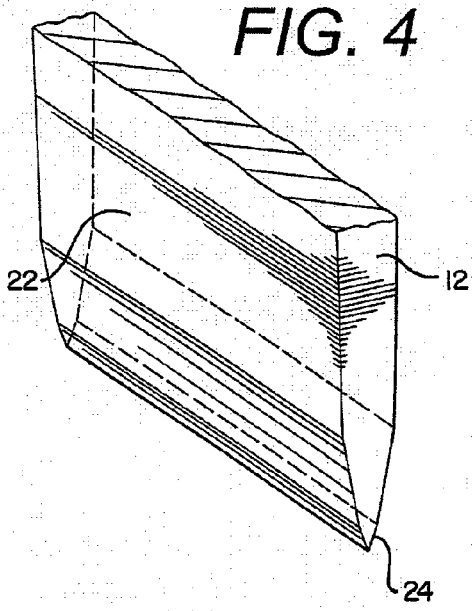
FIG. 4 is a partial detail view, in perspective, of the penetrating end of the wood-splitting tool of FIG. 1.

Referring to FIGS. 1-3, the penetration portion 12 includes two penetration surfaces 22 diverging from each other at an inclusive angle $\alpha$ generally from the penetrating end 16. In a preferred embodiment, as shown in FIG. 4, the penetration end 16 is configured to have a knife-like edge 24, to facilitate initial penetration into the wood. The knife-like edge 24 technically introduces an angle that is greater than a for a small portion of the length of the penetration portion 12. Because of this feature, and among other reasons, one of which is for purposes of clarification herein without imparting unnecessary limitation, the penetration surfaces 22 are referred to as diverging from each other at an inclusive angle $\alpha$ generally from the penetrating end 16.

Referring once again to FIGS. 1-3, the wedge portion 14 includes two wedge surfaces 26, which are generally contiguous with the penetration surfaces 22. As shown in FIG. 3, the two wedge surfaces 26 diverge from each other at an inclusive angle $\beta$, which is greater than the inclusive angle $\alpha$ of the diverging penetration surfaces 22, thereby increasing the wedge properties of the wedge portion 14. In a preferred embodiment, the inclusive angle $\beta$ of the diverging wedge surfaces 26 is at least 2 times the inclusive angle $\alpha$ of the diverging penetration surfaces 22. In a preferred embodiment, the inclusive angle α of the diverging penetration surfaces 22 is from about 2 to 10 degrees. In a preferred embodiment, the inclusive angle β of the diverging wedge surfaces 26 is from about 15 to 25 degrees.

As shown in FIG. 3, the penetration portion 12 has a general length K and the wedge portion 14 has a general length W. The length K of the penetration portion 12 is greater than half the length of the tool 10, which allows the penetration portion 12 to penetrate the piece of wood without significantly imparting a wedge force until the tool penetrates deep enough to allow the wedge portion 14 to engage the wood. In a preferred embodiment, the penetration portion 12 has a length K that is between about ⅔ to ¾ of the length of the tool 10. In a preferred embodiment, the penetration portion 12 has a length K of about 8 inches.

As best shown in FIG. 3, the wedge surfaces 26 are both disposed at a substantially similar distance from the penetrating end 16 of the penetration portion of the tool. This maximizes the wedge force applied to the wood by the wedge portion 14, since both wedge surfaces 26 will be substantially simultaneously engaging the wood. Additionally, in a preferred embodiment, as shown in FIG. 2, each of the wedge surfaces 26 have a width 32 that decreases along a length S of each wedge surface 26 in a direction away from the penetrating end 16 of the tool 10, i.e., the width of the wedge surfaces taper toward the impact end of the tool 10. The decreasing width 32 allows the wedge force to be applied to the wood with minimal increase in surface area engagement as the wedge portion 14 further engages the wood.

The tool 10 can be formed from any material having properties sufficient to withstand impact forces applied thereto by an impact tool, such as, for example, steel or other metallic tool material. In a preferred embodiment, the tool 10 is made of forged or double-forged tool-grade steel.

Figure 5:
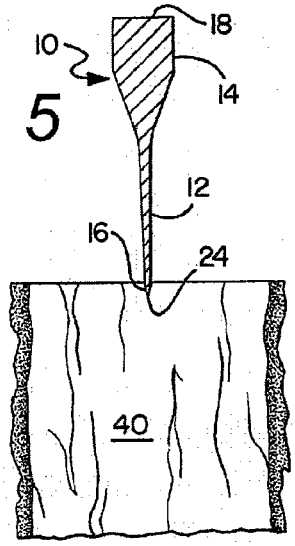
FIGS. 5-8 are cross-sectional illustrations of the wood-splitting tool of FIG. 1 engaging a piece of wood in the form a log, each illustration showing one of three stages of engagement between the wood-splitting tool and the log.
Figure 6:
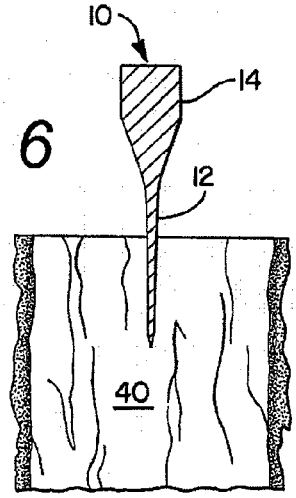
Figure 8:
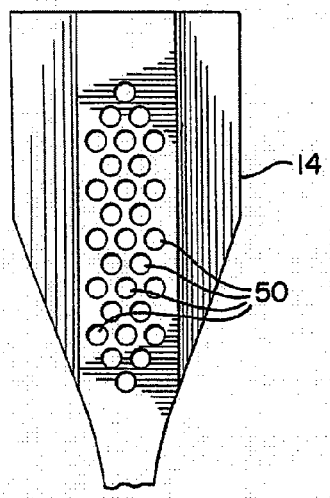
Figure 7:
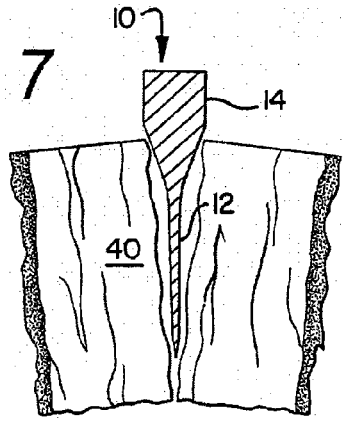

FIGS. 5-7 illustrate three stages of engagement by the tool 10 with a piece of wood in the form of a log 40. In FIG. 5, the penetrating end 16 of the penetration portion 12 initially engages the log 40. At this stage, the knife-like edge 24 works to cut into the log 40 and allow initial penetration of the penetration portion 12 into the log 40. At this stage, the tool 10 can be held in one hand of a user while the other hand can be used to tap the impact end 18 of the tool 10 with an impact tool. FIG. 6 illustrates an intermediate stage wherein the penetration portion 12 of the tool 10 has significantly penetrated the log 40 with minimal splitting of the log 40. By primarily penetrating the log 40 at this stage, rather than applying a wedge force for splitting, the tool 10 is allowed to gain traction against wood fibers of the log 40. Among other things, this prevents the tool from easily disengaging or "popping out" before the log 40 is split. As shown in FIG. 7, not until the full length K of the penetration portion 12 completely penetrates the log 40 does the wedge portion 14 engage the log 40. At this stage, the wedge portion 14 primarily applies a wedge force to the log 40, rather than further penetration into the log 40, and the log 40 is easily split.

The advantages of the present invention are numerous. For example and without limitation, the present invention allows the tool to penetrate into wood without requiring the wood to begin to split for further penetration. It also increases safety by reducing the possibility of the tool from "popping out" of the wood due to inadequate penetration, and, hence, traction in the wood. Additionally, the increased penetration of the tool before application of the wedge force significantly weakens the wood core, which allows the wood to split with reduced wedge force and more efficiency. Furthermore, the penetration and wedge portions of the tool work together to provide overall improved transfer of energy to the wood and efficiency in terms of energy required to be applied to the tool via strikes with the impact tool. These are just some of the many advantages that may become apparent to one of ordinary skill in the art upon review of the disclosure set forth herein.

As previously stated, the foregoing description is not provided to limit the invention to the embodiments described herein. Rather, the scope of the present invention is intended to cover all embodiments that may fall within the scope of the following claims, either literally or under the doctrine of equivalents.

What is claimed is:

1. A tool for splitting wood, the tool having a length and comprising:

a penetration portion having a penetrating end and configured for penetration into a piece of wood, the penetration portion including two penetration surfaces diverging from each other at an inclusive angle; and a wedge portion including two wedge surfaces generally contiguous with the diverging penetration surfaces and diverging from each other at an inclusive angle greater than the inclusive angle of the diverging penetration surfaces;

the penetration portion having a length greater than half the length of the tool.

2. The tool of claim 1, wherein the wedge surfaces are both disposed at a substantially similar distance from the penetrating end of the penetration portion of the tool.

3. The tool of claim 1, wherein the wedge surfaces each have a width that decreases along a length of each wedge surface in a direction away from the penetrating end.

4. The tool of claim 1, wherein the penetration portion has a length which is between about ⅔ to ¾ of the length of the tool.

5. The tool of claim 1, wherein the penetration portion has a length of about 8 inches.

6. The tool of claim 1, wherein the inclusive angle of the diverging wedge surfaces is at least 2 times the inclusive angle of the diverging penetration surfaces.

7. The tool of claim 1, wherein the inclusive angle of the diverging penetration surfaces is from about 2 to 10 degrees.

8. The tool of claim 1, wherein the inclusive angle of the diverging wedge surfaces is from about 15 to 25 degrees.

9. A tool for splitting wood, the tool comprising an elongated body defining a penetration portion having a penetrating end and configured for penetration into a piece of wood; and a wedge portion having an impact end configured to accept impact from an impacting tool; the penetration portion including two diverging penetration surfaces diverging from each other at an inclusive angle, the wedge portion including two diverging wedge surfaces generally contiguous with the diverging penetration surfaces and diverging from each other at an inclusive angle greater than the inclusive angle of the diverging penetration surfaces, the diverging wedge surfaces each having a width that decreases along a length of each wedge surface in a direction toward the impact end.

10. The tool of claim 9, wherein the tool has a length and the penetration portion has a length greater than half the length of the tool.

11. The tool of claim 9, wherein the tool has a length and the penetration portion has a length which is between about ⅔ to ¾ of the length of the tool.

12. The tool of claim 9, wherein the diverging wedge surfaces are both disposed at a substantially similar distance from the penetrating end of the penetration portion of the tool.

13. The tool of claim 9, wherein the wedge surfaces are planar.

14. The tool of claim 13, wherein the diverging wedge surfaces are both disposed at a substantially similar distance from the penetrating end of the penetration portion of the tool.

15. The tool of claim 9, wherein the inclusive angle of the diverging wedge surfaces is at least 2 times the inclusive angle of the diverging penetration surfaces.

16. A tool for splitting wood, the tool having a length and comprising:

a penetration portion having a penetrating end and configured for penetration into a piece of wood, the penetration portion including two penetration surfaces diverging from each other at an inclusive angle; and a wedge portion including two generally planar wedge surfaces generally contiguous with the diverging penetration surfaces and diverging from each other at an inclusive angle greater than the inclusive angle of the diverging penetration surfaces, the diverging wedge surfaces both disposed at a substantially similar distance from the penetrating end.

17. The tool of claim 16, wherein the penetration portion has a length greater than half the length of the tool.

18. The tool of claim 16, wherein the penetration portion has a length which is between about ⅔ to ¾ of the length of the tool.

19. The tool of claim 16, wherein the wedge surfaces each have a width that decreases along a length of each wedge surface in a direction away from the penetrating end.

20. The tool of claim 16, wherein the inclusive angle of the diverging wedge surfaces is at least 2 times the inclusive angle of the diverging penetration surfaces.

21. A wood-splitting tool comprising an elongated body defining a penetration portion having a penetrating end and configured for penetration into a piece of wood without imparting any significant wedge force to the piece of wood; and a wedge portion having an impact end configured to accept impact from an impacting tool to drive the wood-splitting tool into the piece of wood, the wedge portion having at least one wedge surface configured to impart a wedge force to the piece of wood to cause the piece of wood to split, the penetration portion having a length equal to at least half the elongated body of the wood-splitting tool to allow significant penetration of the tool into the piece of wood before imparting the wedge force.

* * * * *